United States Patent [19]

Yamamoto et al.

[11] Patent Number: 4,972,815

[45] Date of Patent: Nov. 27, 1990

[54] INTAKE AIR QUANTITY REGULATING DEVICE FOR AN AUTOMOBILE ENGINE

[75] Inventors: Kazuyoshi Yamamoto; Hirokazu Maehara; Mamoru Sumida; Osamu Matsumoto, all of Himeji, Japan

[73] Assignee: Mitsubishi Denki Kabushiki Kaisha, Tokyo, Japan

[21] Appl. No.: 390,809

[22] Filed: Aug. 8, 1989

[51] Int. Cl.[5] ..... F02D 9/10

[52] U.S. Cl. ..... 123/337; 251/356

[58] Field of Search ..... 123/337; 251/308, 356; 29/157.1 R; 261/65

[56] References Cited

U.S. PATENT DOCUMENTS 4,438,745 3/1984 Watanabe ..... 123/337 X

FOREIGN PATENT DOCUMENTS 63-60036 4/1988 Japan .

*Primary Examiner*—Tony M. Argenbright

*Attorney, Agent, or Firm*—Sughrue, Mion, Zinn, Macpeak and Seas

[57] ABSTRACT

Grooves 6 having a length larger than the diameter of shaft 2 are formed in both surfaces of throttle valve 3 between mounting screws 4 and the inner circumferential wall of throttle body 1, perpendicular to the shaft axis, to capture any excess adhesive applied to the screws and migrating outwardly therefrom.

3 Claims, 2 Drawing Sheets

INTAKE AIR QUANTITY REGULATING DEVICE FOR AN AUTOMOBILE ENGINE

BACKGROUND OF THE INVENTION

FIELD OF THE INVENTION

The present invention relates to an intake air quantity regulating device for an automobile engine.

DISCUSSION OF BACKGROUND

FIG. 2 is a longitudinal cross-sectional view of a conventional intake air quantity regulating device for an engine, wherein a reference numeral 1 designates a throttle body through which intake air is passed to the engine. A shaft 2 is supported in and by the inner circumferential surface of the throttle body 1 by means of bearings 5 in a freely rotatable manner and is extended in the direction perpendicular to a stream of the intake air. The shaft 2 is connected to an accelerator pedal (not shown) so as to be movable in association therewith. An elongate slot or through hole 2*a* is formed in the shaft 2 in an area of the opening portion formed in the throttle body 1. A throttle valve 3 of a disk-like-form is inserted in the through hole 2*a* and is firmly connected to the shaft with screws 4 applied with an anaerobic adhesive which is used for strenghening the screw-engagement of the shaft 2 with the throttle valve 3.

In the conventional apparatus having the abovementioned construction, when a driver operates the accelerator pedal, the throttle valve 3 is turned along with the shaft 2 to change the surface area of the opening of the throttle body 1, whereby a flow rate of the intake air flowing in the throttle body 1 to the engine can be adjusted.

In the conventional intake air quantity regulating device, however, when an excessive amount of anaerobic adhesive is unnecessarily applied to the screws 4, an excessive amount of adhesive flows between the through hole 2*a* of the shaft 2 and the throttle valve 3 by capillary action, so that it reaches the inner circumferential wall of the throttle body 1. The adhesive solidifies between the inner circumferential wall and the shaft 2 or between the circumferential wall and the throttle valve 3 to thereby cause the malfunction of the throttle valve 3. Namely, when the solidification of the adhesive immediately occurs, a faulty product is found in a manufacturing line. When the solidification occurs after several weeks, a faulty product is found when it is used.

SUMMARY OF THE INVENTION

It is an object of the present invention to provide an intake air quantity regulating device capable of eliminating the solidification of an adhesive between the throttle body and the shaft or between the throttle body and the throttle valve to thereby eliminate the malfunction of the throttle valve.

The foregoing and other objects of the present invention have been attained by providing an intake air quantity regulating device comprising a throttle body to permit intake air for an engine to pass therethrough, a shaft supported in and by the throttle body so as to extend in the direction perpendicular to a stream of the intake air and capable of swinging in association with an accelerator pedal, and a throttle valve inserted in a through hole formed in the shaft in the throttle body and firmly attached to the shaft by at least one screw applied with an adhesive at a position in the through hole, the throttle valve being driven by the accelerator pedal to change the surface area of the opening of the throttle body to thereby regulate a quantity of intake air, wherein grooves having a length larger than the diameter of the shaft are formed in both surfaces of the throttle valve at positions extending across the through hole and between the at least one screw and the inner circumferential wall of the throttle body so as to be perpendicular to the axial line of the shaft.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
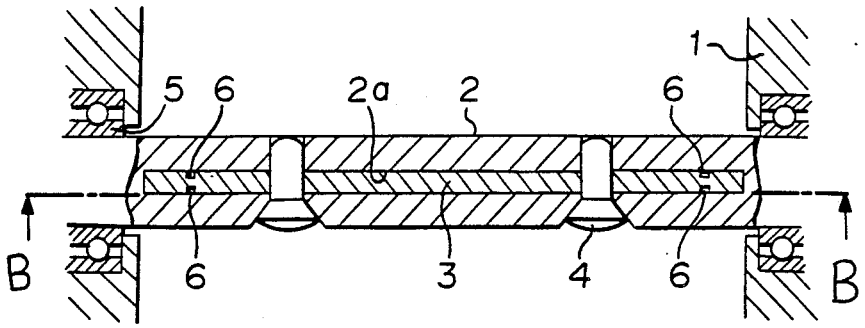
FIG. 1A is a longitudinal cross-sectional view of an embodiment of the intake air quantity regulating device according to the present invention.
FIG. 1B is a cross-sectional view taken along a line B—B in FIG. 1A.
Figure 1:
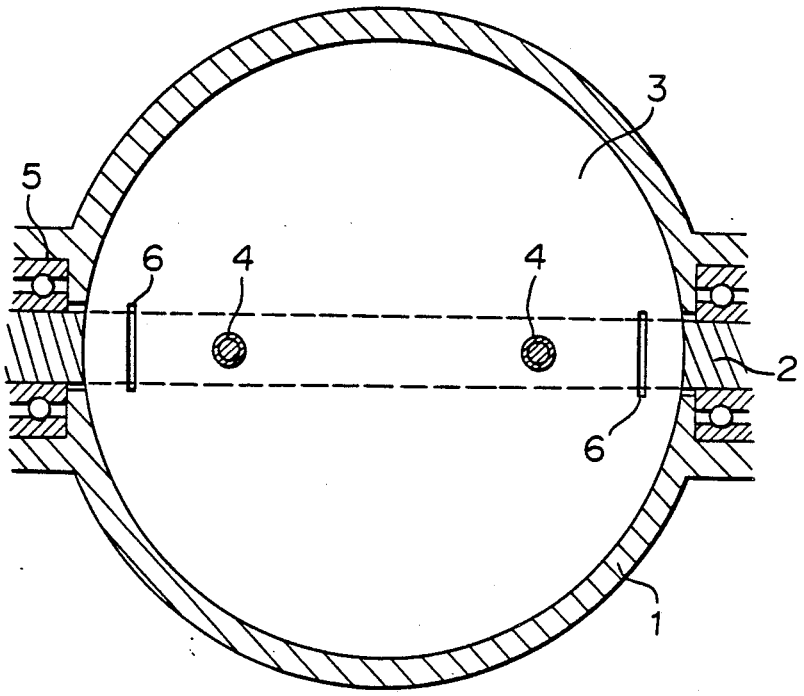
Figure 2:
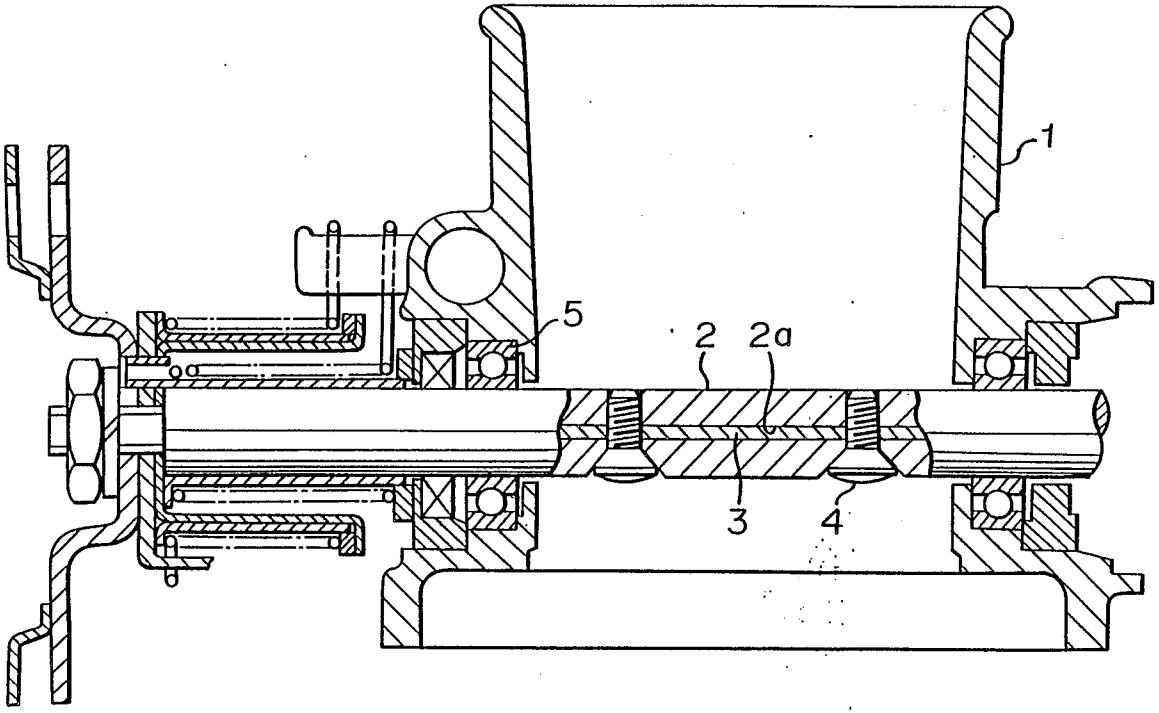
FIG. 2 is a longitudinal cross-sectional view of a conventional intake air quantity regulating device.

Referring to the drawings, wherein the same reference numerals designate the same or corresponding parts throughout the several views, and more particularly to FIGS. 1A and 1B thereof, there are shown cross-sectional views of a typical example of the intake air quantity regulating device of the present invention. In FIGS. 1A and 1B, grooves 6 each having the same length as the diameter of the shaft 2 or a length larger than the diameter of the shaft 2 are formed in both surfaces of the throttle valve 3 at the positions in the through hole of the shaft 2 and between the screws 4 applied with an anaerobic adhesive and the inner circumferential wall of the throttle body 1 so as to be perpendicular to the axial line of the shaft 2. It is preferable that the grooves are linear grooves and are formed at the corresponding positions of the both surfaces of the throttle valve. The other structural elements are the same as those of the conventional device. The grooves 6 may be formed by punching operations. In FIGS. 1A and 1B, four linear grooves are formed. However, different shapes and a different number of grooves can be employed.

With the construction as described above, the anaerobic adhesive is accumulated in the grooves 6 even though an excessive amount of adhesive applied to the screws 4 flows between the slot or through hole 2*a* and the throttle valve 3 toward the inner circumferential wall of the throttle body 1, and it solidifies before it reaches the inner circumferential wall. Accordingly, there is no danger of sticking of the throttle body 1 to the shaft 2 or the throttle valve 3 by the adhesive, hence the movement of the throttle valve 3 is not hindered. Accordingly, inconvenience in use and/or in a manufacturing process can be eliminated. Further, it is unnecessary to make the control of applying the adhesive and fastening the screws to be severe.

Obviously, numerous modifications and variations of the present invention are possible in light of the above teachings. It is therefore to be understood that within the scope of the appended claims, the invention may be practiced otherwise than as specifically described herein.

What is claimed is:

1. An intake air quantity regulating device comprising a throttle body to permit intake air for an engine to pass therethrough, a shaft supported in and by said throttle body so as to extend in a direction perpendicular to a stream of intake air and capable of swinging in association with an accelerator pedal, and a throttle valve inserted in a through hole formed in said shaft in said throttle body and firmly attached to said shaft by at least one screw applied with an adhesive at a position in said through hole, said throttle valve being driven by said accelerator pedal to change the surface area of an opening of said throttle body to thereby regulate a quantity of intake air, wherein grooves having a length larger than the diameter of said shaft are formed in both surfaces of said throttle valve at positions extending across the through hole and between said at least one screw and the inner circumferential wall of said throttle body so as to be perpendicular to an axis of said shaft.

2. The intake air quantity regulating device according to claim 1, wherein said grooves have the same shape and are formed at corresponding positions of both surfaces of said throttle valve.

3. The intake air quantity regulating device according to claim 2, wherein said grooves are linear grooves.

* * * * *